US010312639B2

(12) United States Patent
Chen

(10) Patent No.: US 10,312,639 B2
(45) Date of Patent: Jun. 4, 2019

(54) SHIELDED BOARD-TO-BOARD CONNECTOR ASSEMBLY

(71) Applicant: FOXCONN INTERCONNECT TECHNOLOGY LIMITED, Grand Cayman (KY)

(72) Inventor: Chin-Yu Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/851,710

(22) Filed: Dec. 21, 2017

(65) Prior Publication Data

US 2018/0175561 A1 Jun. 21, 2018

(30) Foreign Application Priority Data

Dec. 21, 2016 (CN) ..... 2016 1 1191015

(51) Int. Cl.

| | |
|---|---|
| ***H01R 12/00*** | (2006.01) |
| ***H01R 13/6594*** | (2011.01) |
| ***H01R 12/71*** | (2011.01) |
| ***H01R 12/52*** | (2011.01) |
| ***H01R 12/70*** | (2011.01) |
| ***H01R 12/73*** | (2011.01) |
| *H01R 13/41* | (2006.01) |
| *H01R 13/20* | (2006.01) |

(52) U.S. Cl.

CPC ..... *H01R 13/6594* (2013.01); *H01R 12/52* (2013.01); *H01R 12/707* (2013.01); *H01R 12/716* (2013.01); *H01R 12/73* (2013.01); *H01R 13/20* (2013.01); *H01R 13/41* (2013.01)

(58) Field of Classification Search

CPC .... H01R 13/6594; H01R 12/52; H01R 13/41; H01R 12/716

USPC ..... 439/74, 607.36

See application file for complete search history.

(56) References Cited

U.S. PATENT DOCUMENTS 6,503,101 B1 * 1/2003 Yu ..... H01R 13/6597 439/607.36

8,888,506 B2 * 11/2014 Nishimura ..... H01R 12/7082 439/74

(Continued)

FOREIGN PATENT DOCUMENTS

TW M435072 8/2012

*Primary Examiner* — Abdullah A Riyami

*Assistant Examiner* — Nelson R. Burgos-Guntin

(74) *Attorney, Agent, or Firm* — Wei Te Chung; Ming Chieh Chang

(57) ABSTRACT

An electrical connector assembly includes a receptacle connector and a plug connector wherein the receptacle connector has an insulative housing with a plurality of contacts therein, and metallic shielding shell covering the housing. The housing includes a peripheral wall surrounding an island to form a mating cavity therebetween wherein the shielding shell covers the exterior surfaces of the peripheral wall and further provides pressing section upon an interior surfaces thereof. The plug connector has an insulative housing and a plurality of contacts therein, and a metallic shielding shell cover the housing. The housing forms a receiving cavity to receive the island. The shielding shell of the plug connector forms a recess in the outer abutting section to engage the pressing section of the receptacle connector during mating.

15 Claims, 11 Drawing Sheets

(56) References Cited

U.S. PATENT DOCUMENTS

| | | | | |
|---|---|---|---|---|
| 8,986,027 | B2 * | 3/2015 | Nishimura | H01R 12/707 439/181 |
| 2005/0032400 | A1 * | 2/2005 | Zhang | H01R 13/41 439/74 |
| 2005/0042924 | A1 * | 2/2005 | Zhang | H01R 13/6582 439/607.36 |
| 2006/0063432 | A1 * | 3/2006 | Chen | H01R 13/658 439/607.36 |
| 2006/0276061 | A1 * | 12/2006 | Koguchi | H01R 12/725 439/74 |
| 2008/0207014 | A1 * | 8/2008 | Takeuchi | H01R 13/6275 439/74 |
| 2008/0305657 | A1 * | 12/2008 | Midorikawa | H01R 4/028 439/74 |
| 2009/0061655 | A1 * | 3/2009 | Miyazaki | H01R 12/57 439/74 |
| 2010/0068900 | A1 * | 3/2010 | Wu | H01R 12/716 439/74 |
| 2011/0263140 | A1 * | 10/2011 | Sato | H01R 12/7052 439/74 |
| 2013/0012039 | A1 * | 1/2013 | Nose | H01R 12/716 439/74 |
| 2015/0079816 | A1 * | 3/2015 | Suzuki | H01R 12/716 439/74 |
| 2015/0140840 | A1 * | 5/2015 | Nishimura | H01R 12/79 439/74 |
| 2015/0140841 | A1 * | 5/2015 | Watanabe | H01R 12/7011 439/74 |
| 2015/0207248 | A1 * | 7/2015 | Takenaga | H01R 12/716 439/74 |
| 2016/0190719 | A1 * | 6/2016 | Brzezinski | H01R 12/73 439/74 |

* cited by examiner

SHIELDED BOARD-TO-BOARD CONNECTOR ASSEMBLY

FIELD OF THE DISCLOSURE

The invention is related to an electrical connector assembly, and particularly to the board-to-board connector assembly with the metallic shielding shells covering the corresponding housing circumferentially.

DESCRIPTION OF RELATED ARTS

Taiwan Patent No. M435072 discloses the board-to-board electrical connector assembly each equipped with a metallic shielding shell. Anyhow, the shielding shell is not structured with a full shielding effect disadvantageously.

It is desired to provide a board-to-board connector assembly wherein each mating connector is equipped with a metallic shielding shell sufficiently covering the housing and efficiently providing shielding effect.

SUMMARY OF THE DISCLOSURE

To achieve the above desire, an electrical connector assembly includes a receptacle connector and a plug connector wherein the receptacle connector has an insulative housing with a plurality of contacts therein, and metallic shielding shell covering the housing. The housing includes a base and a peripheral wall surrounding an island to form a mating cavity therebetween wherein the shielding shell covers the exterior surfaces of the peripheral wall and further provides pressing section upon an interior surfaces thereof. Correspondingly, the plug connector has an insulative housing and a plurality of contacts therein, and a metallic shielding shell cover the housing. The housing forms a receiving cavity to receive the island. The shielding shell of the plug connector forms a recess in the outer abutting section to engage the pressing section of the receptacle connector during mating. Therefore, a good mechanical and electrical connection between the receptacle connector and the plug connector can be achieved.

DETAILED DESCRIPTION OF THE PREFERRED EMBODIMENT

Figure 1:
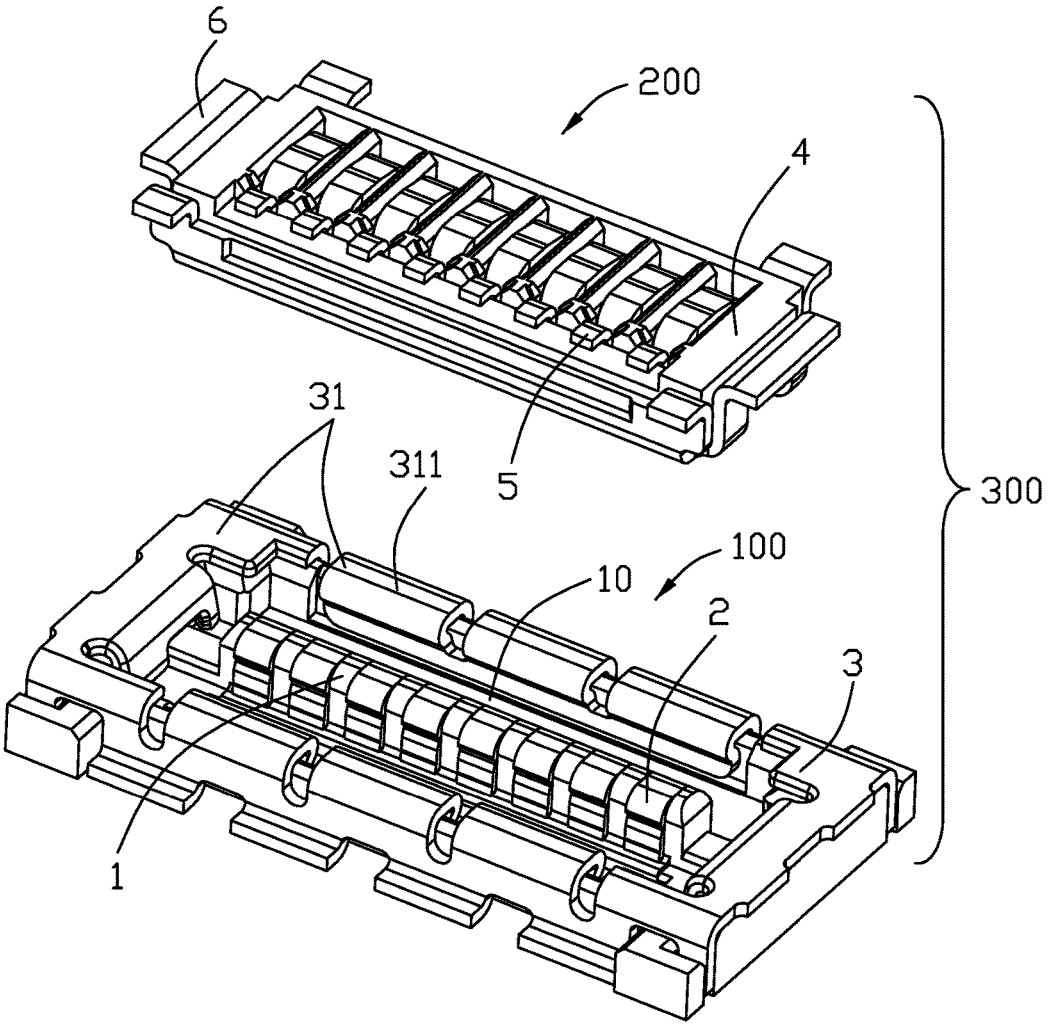
FIG. 1 is a perspective view of the electrical connector assembly of the invention wherein the receptacle connector and the plug connector are not mated with each other.
Figure 2:
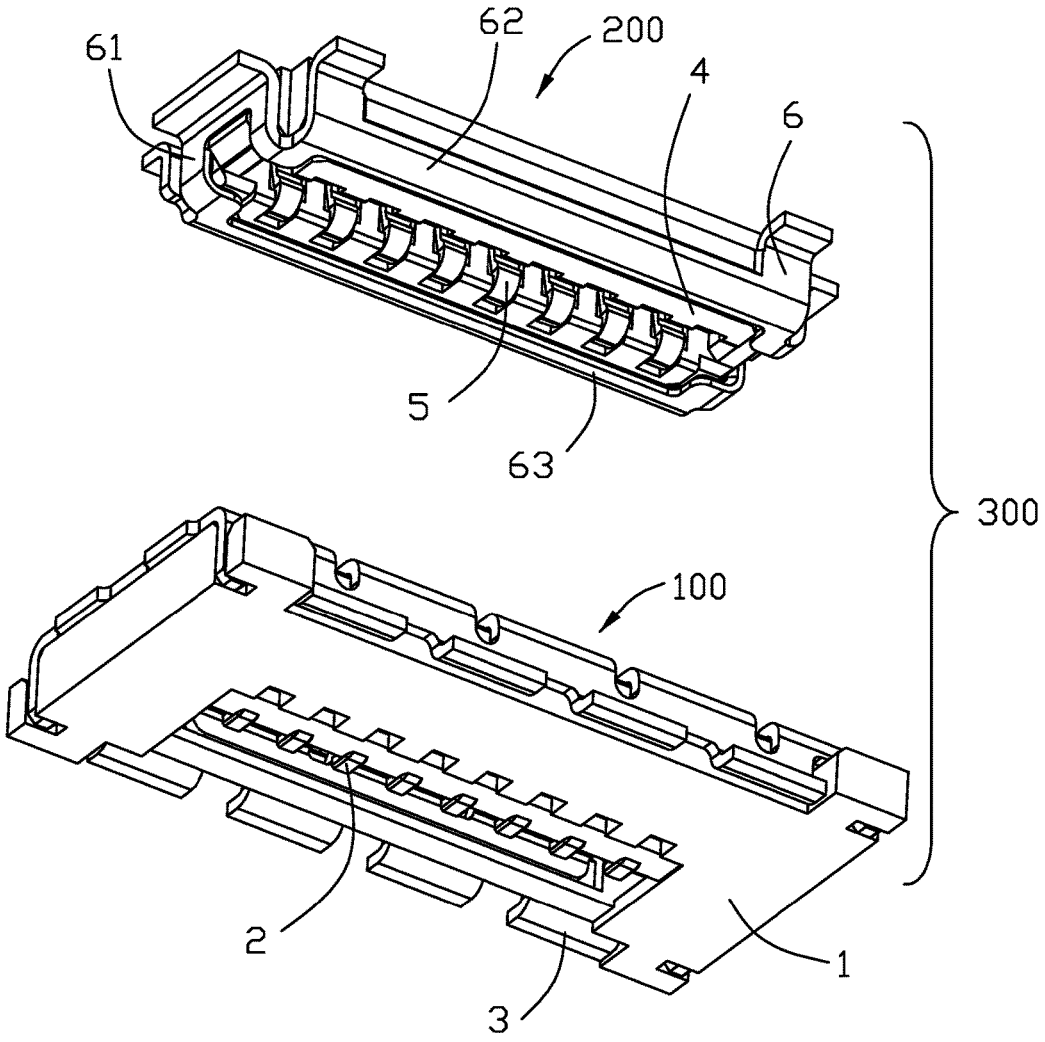
FIG. 2 is another perspective view of the electrical connector assembly of FIG. 1.
Figure 3:
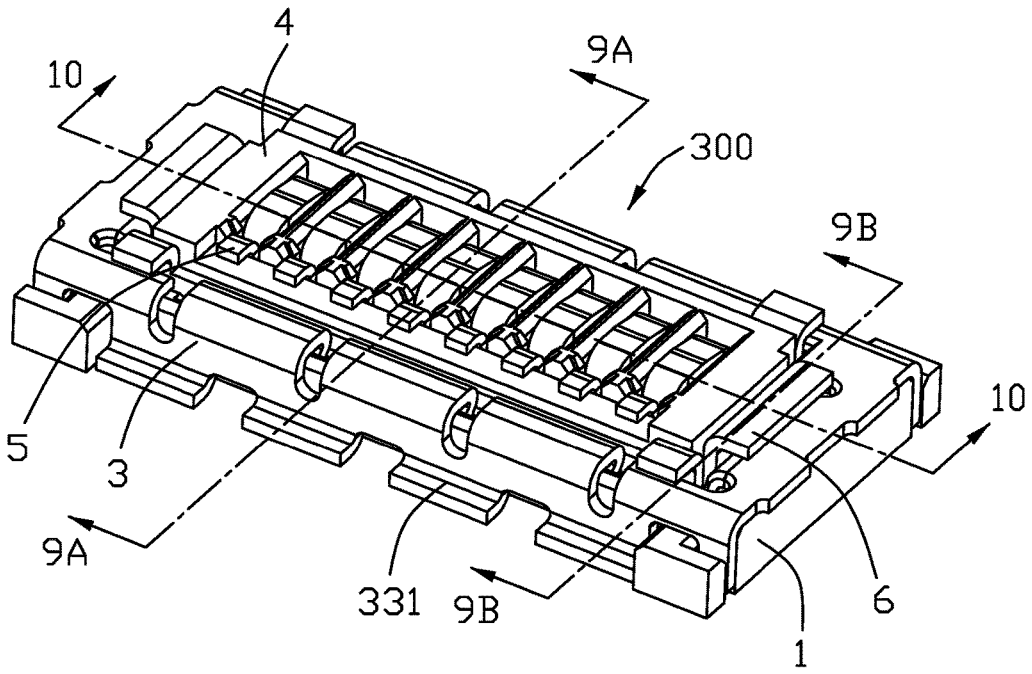
FIG. 3 is a perspective view of the electrical connector assembly of FIG. 1 wherein the receptacle connector and the plug connector are mated together.
Figure 4:
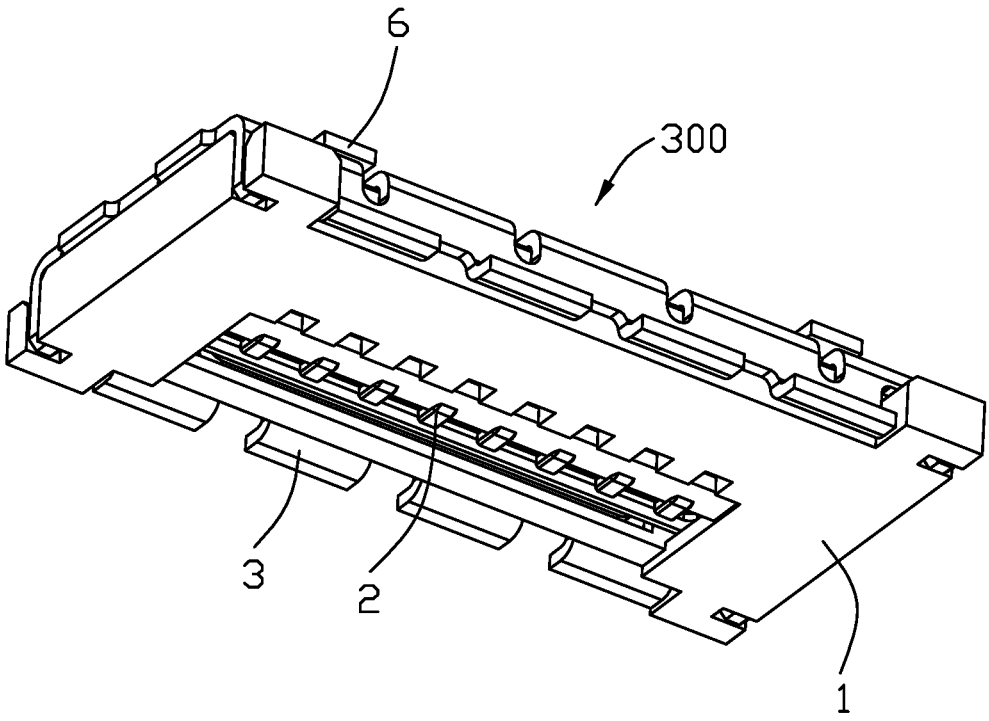
FIG. 4 is another perspective view of the electrical connector assembly of FIG. 3.
Figure 5:
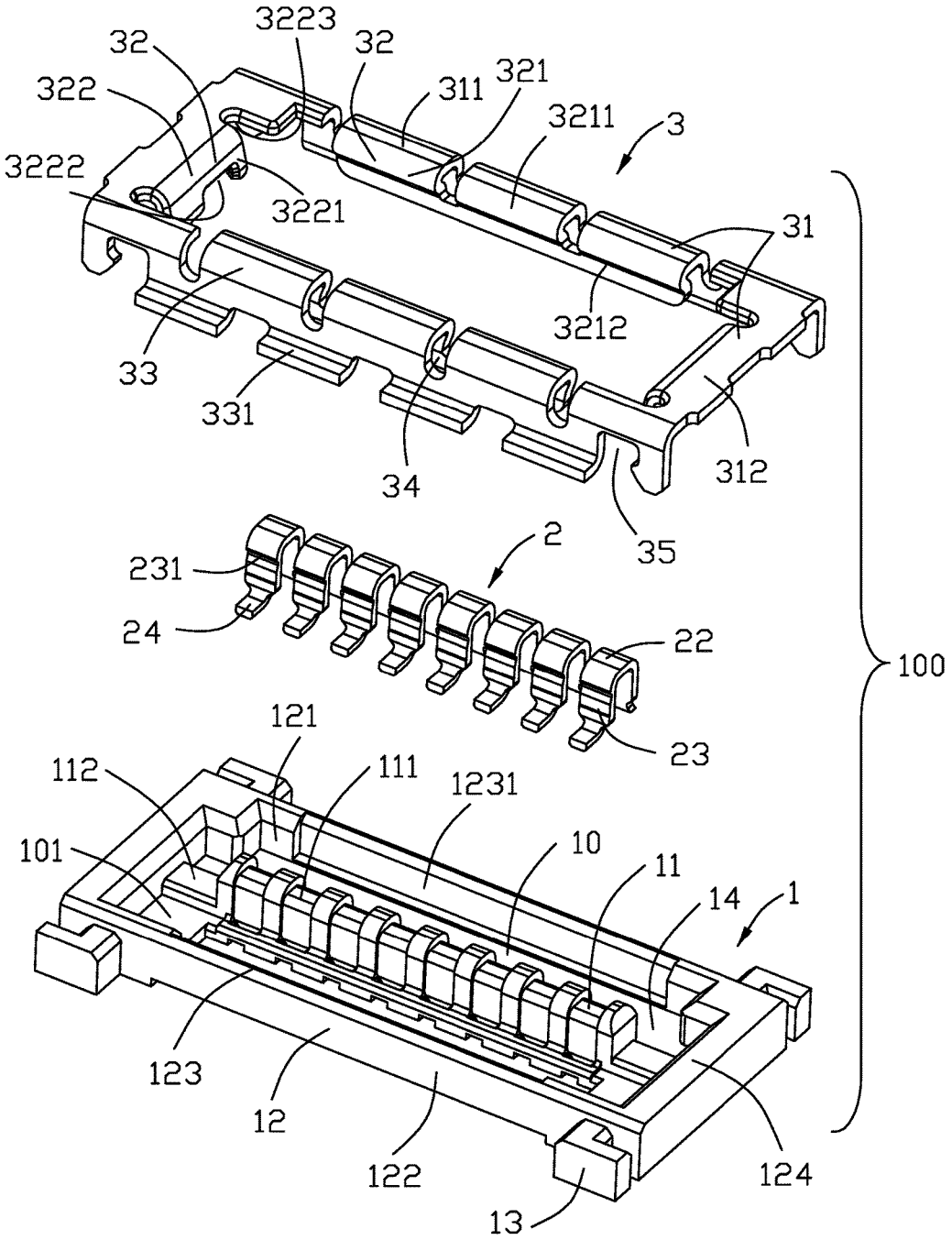
FIG. 5 is an exploded perspective view of the receptacle connector of the electrical connector assembly of FIG. 1.
Figure 6:
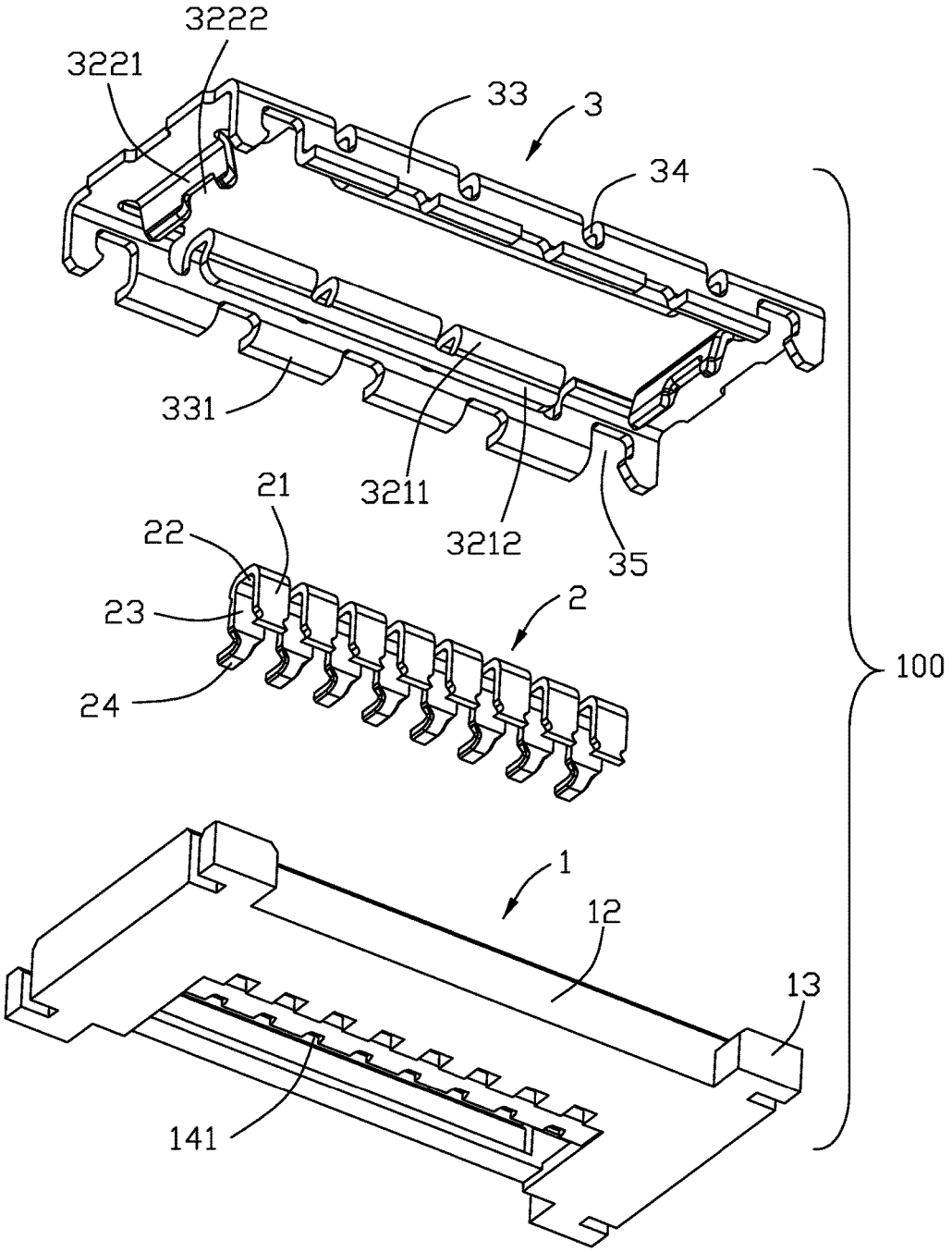
FIG. 6 is another exploded perspective view of the electrical connector of the electrical connector assembly of FIG. 5.
Figure 7:
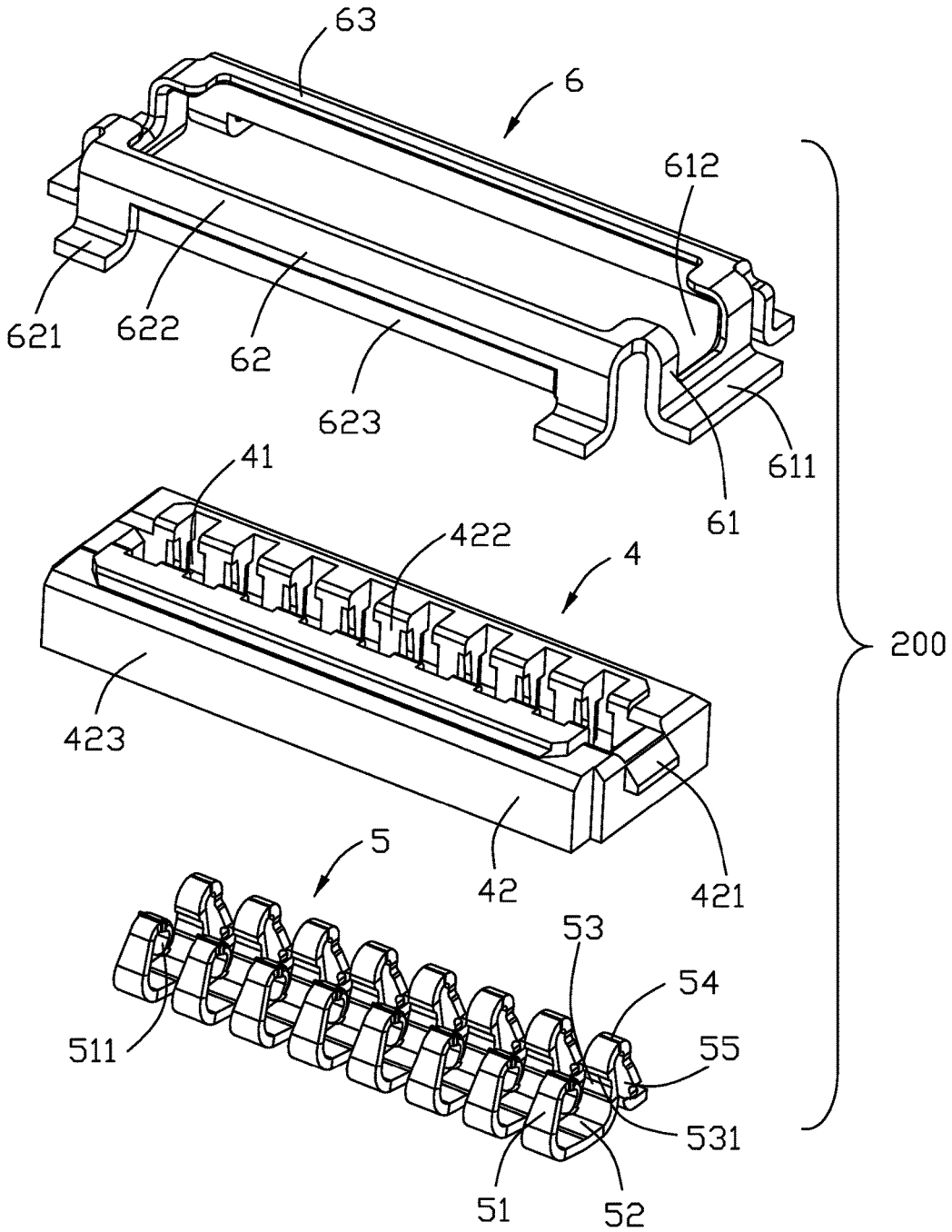
FIG. 7 is an exploded perspective view of the plug connector of the electrical connector assembly of FIG. 1
Figure 8:
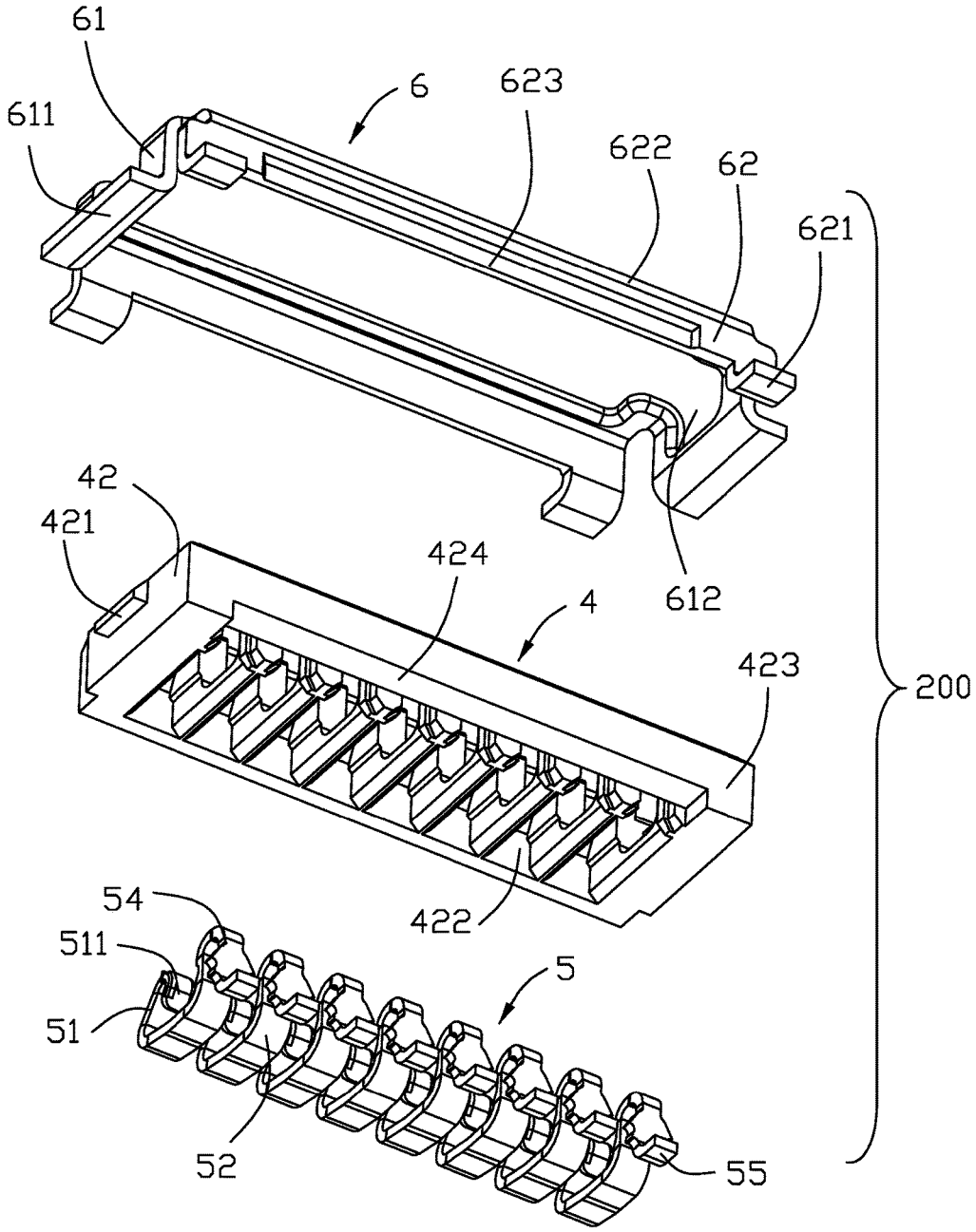
FIG. 8 is another exploded perspective view of the plug connector of the electrical connector assembly of FIG. 7.
Figure 9A:
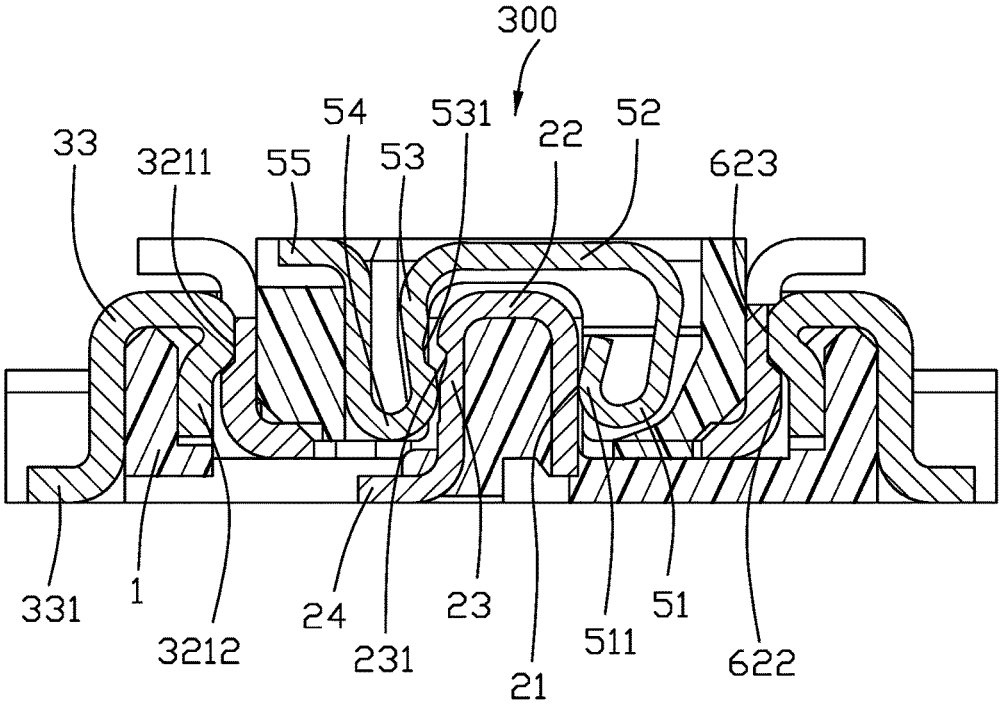
FIG. 9(A) is a cross-sectional view of the electrical connector assembly of FIG. 1.
Figure 9B:
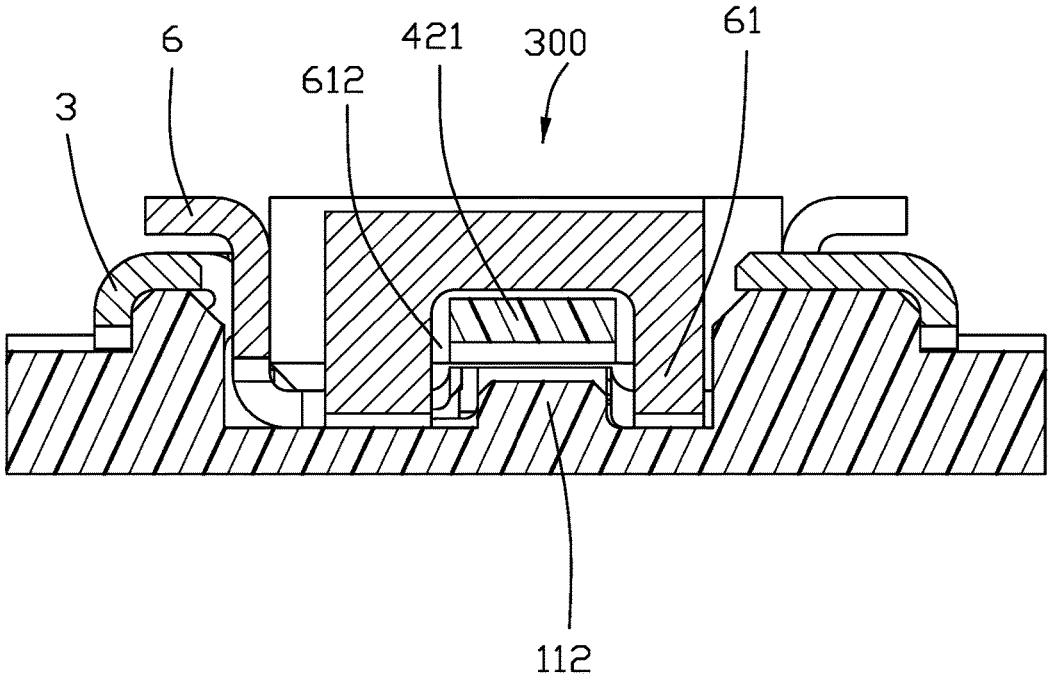
FIG. 9(B) is another cross-sectional view of the electrical connector assembly of FIG. 1.
Figure 10:
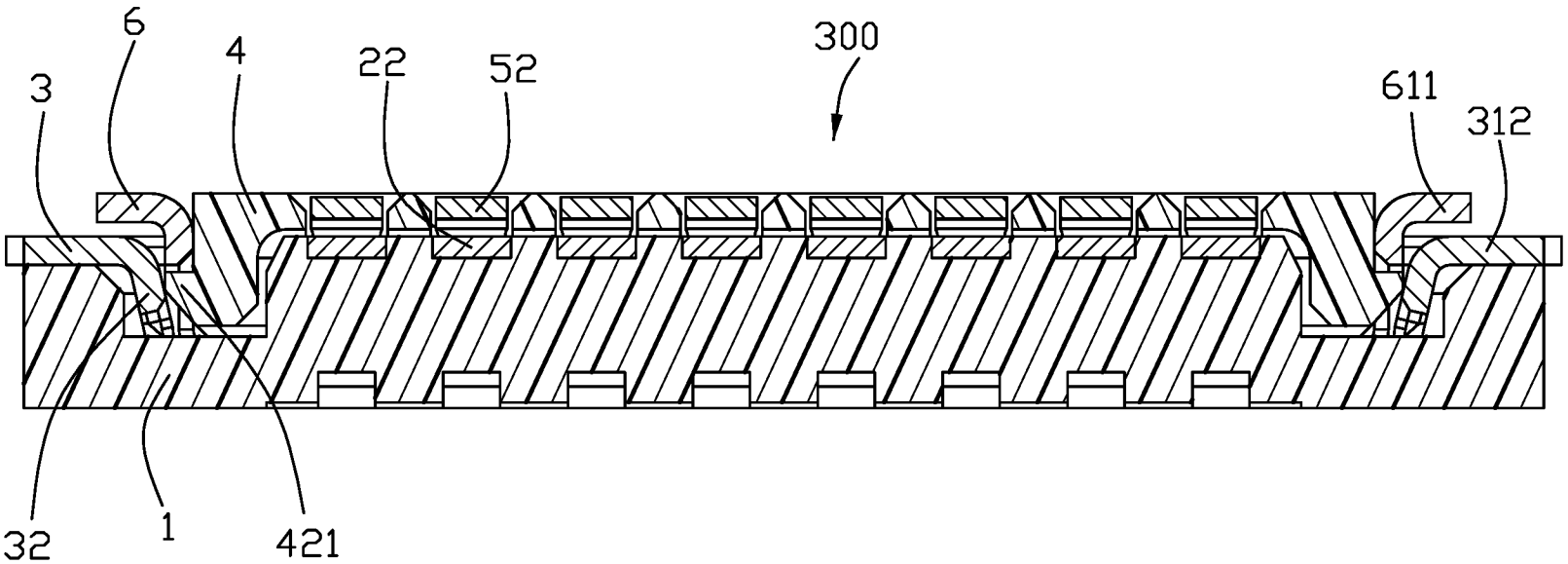
FIG. 10 is another cross-sectional view of the electrical connector assembly of FIG. 1.

Reference will now be made in detail to the embodiments of the present disclosure. Referring to FIGS. 1-10, an electrical connector assembly 300 includes a receptacle connector 100 mounted upon a printed circuit board (not shown) for mating with a plug connector 200 mounted upon another printed circuit board (not shown). The receptacle connector 100 includes an insulative housing 1, a plurality of contacts 2 retained to the housing 1, and a metallic shielding shell 3 covering the housing 1.

The insulative housing 1 includes a base 14, an island 11 extending upwardly from the base 14, a peripheral wall 12 cooperating with the island 11 to form a frame like mating cavity 10. The peripheral wall 12 forms an interior surface 121 facing the island 11, and an exterior surface 122 opposite to the inner surface 121. The peripheral wall 12 includes a pair of first side walls 123 and a pair of second side walls or end walls 124. The first side wall 123 forms a recess 1231 in the interior surface. The housing 1 further includes a pair mounting sections 13 by two sides of the first side wall 123. The island 11 forms a plurality of grooves 111 and a pair of protrusions 112 at two opposite ends of the island 11. The base 14 forms a plurality of though holes 141 communicatively aligned with the corresponding grooves 111. A pair of receiving sections 101 are located at two opposite ends in which the protrusions 112 are located.

The contacts 2 are received within the corresponding grooves 111. Each contact 2 has a contacting section exposed upon the island 11. The contacting section includes a first contacting section 21 and a second contacting section 23 exposed upon two opposite sides of the island 11 and linked by an arc connection section 22 located upon a top edge of the island 11. The contact 2 further includes a first horizontal soldering section 24. The second contacting section 23 includes a first recess 231. The first horizontal soldering section 24 extends through the through hole 141 to be exposed upon the bottom surface of the connector 100 for soldering to the printed circuit board (not shown).

The metallic shielding shell 3 continuously extends to cover the peripheral wall 12 and includes a pressing section 3 exposed upon the interior surface 121. Alternately, the shielding shell 3 may be integrally formed with the housing 1. In this embodiment, the shielding shell 3 is downwardly assembled upon the housing 12 and includes an upper part 31 from which the pressing section 32 is formed.

The upper part 31 includes the first upper part 311 upon the first side wall 123 and the second upper part 312 upon the second side wall 124 wherein the first upper part 311 and the second upper part 312 are linked with each other around the corner of the first side wall 123 and the second side wall 124. The upper part further includes a first outer part 33 upon the first side wall 123 with the corresponding soldering legs 331.

The pressing section 32 includes the first pressing section 321 upon the interior surface 121 of the first side wall 123, and the second pressing section 322 upon the interior surface 121 of the second side wall 124. The first pressing section 321 includes a protruding section 3211 and the pressing region 3212 under the protruding section 3211. Both the protruding section 3211 and the pressing region 3212 are located within the corresponding recess 1231 wherein the pressing region 3212 presses the interior surface of the recess 1231. A plurality of slots 34 are formed around the first upper part 311, the first pressing section 321 and the outer part 33 so as to separate the first pressing section 321 into plural portions.

The first pressing section 321 is applied to the first side wall 123 symmetrically with regard to the island 11. The soldering legs 331 extend from the bottom of the outer wall 133 and under the slots 34, respectively, for reinforcing the strength thereabouts due to forming the slots 34. The second pressing section 322 includes a protruding section 3221 between the first cutout 3222 and the second cutout 3223 in the transverse direction. The second cutout 3222 receives the corresponding protrusion 112. The shielding shell 3 further includes notches 35 to retain the corresponding mounting section 13 for securing the shielding shell 3 upon the housing 1.

The plug connector 200 includes an insulative housing 4, a plurality of mating contacts 5 disposed in the housing 4, and the metallic shielding shell 6 applied upon the housing 4. The housing 4 includes a center receiving cavity 41 and the peripheral wall 42. The peripheral wall 42 forms an interior surface 422 facing toward the receiving cavity 41, and an exterior surface 423 opposite to the interior surface 422. The peripheral wall 42 forms blocks 421 at two opposite ends. The peripheral wall 42 forms a recessed region 424 in an undersurface.

The mating contact 5 is mated with the contact 2. The contact 5 is retained to the peripheral wall 42 and includes a first contacting section/portion 51 and a second contacting section/portion 53 linked by the horizontal connecting section/portion 52, an upside-down U-shaped connecting section/portion 54 linked to the second contacting section 53, and a second horizontal soldering section/portion 55 linked to the upside-down U-shaped connecting portion 54. The second horizontal soldering section 55 is received within the recessed region 424. The end of the first contacting section 51 forms a upside-down U-shaped hook 511, and the second contacting section 53 forms a second recess 531. The second horizontal soldering section 55 extends through the bottom of the housing 4 and is received within the recessed region 424 to be exposed upon the bottom of the connector for soldering to the printed circuit board (not shown)

The metallic shielding shell 6 covers the exterior surfaces 423 of the peripheral wall 42. The shielding shell 6 is downwardly assembled upon the peripheral wall 42 and includes an upper part 63, an outer part or abutment section 62 and an end part 61. The end part 61 includes a soldering section 611 and a notch 612 located above the soldering section 611 to receive the corresponding block 421 for securing the shielding shell 6 to the housing 4. The outer part 62 includes the second soldering section 621, the covering section 622, and a recess 623 under the covering section 622.

During mating the plug connector 200 with the receptacle connector 100, the peripheral wall 42 of the plug connector 200 is inserted into the mating cavity 10 and the island 11 is received within the receiving cavity 41. In this embodiment, the engagement between the protruding section 3221 and the end part is relatively minor while the protruding section 3211 is received within the recess 623 with a click sound. The notch 612 receives the protrusion 112, the upside-down U-shaped hook 511 of the contact 5 contacts the first contacting section 21 of the contact 2, and the second recess 531 of the second contacting section 53 of the contact 5 and the first recess 231 of the second contacting section 23 of the contact 2 are mutually engaged with each other.

In brief, the shielding shell 3 covers both the interior surfaces 121 and the exterior surface 122 of the first side wall 123 for not only enhancing the shielding effect but also the structural strength. The retention between the receptacle connector 100 and the plug connector 200 can be performed by engagement between the protruding section 3211 of the shielding shell 3 of the receptacle connector 200 and the recess 623 of the shielding shell 6, thus more efficiently.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

a receptacle connector including:

an insulative housing including an island surrounded by a peripheral wall with a mating cavity therebetween, the peripheral wall including a pair of side walls each defining opposite interior surface and outer surface, a recess formed in the interior surface;

a plurality of contacts retained in the housing, each of the contacts including a contacting section exposed upon the island;

a metallic shielding shell attached upon the peripheral wall and including an upper part, a pressing section extending downwardly from the upper part and received within the recess, and an outer part covering the exterior surface;

wherein the housing includes a pair of mounting sections at two opposite ends thereof, and the shielding shell includes a notch retained to the mounting section for securing the shielding shell to the housing.

2. The electrical connector assembly as claimed in claim 1, wherein the outer part further includes a plurality of soldering legs.

3. The electrical connector assembly as claimed in claim 1, wherein a plurality of slots are formed in the shielding shell around the upper part to separate the pressing section into plural portions.

4. The electrical connector assembly as claimed in claim 1, wherein the housing includes a pair of protrusions along a centerline of the housing and linked at two opposite ends of the island in a longitudinal direction.

5. The electrical connector assembly as claimed in claim 1, further including a plug connector having an insulative housing, a plurality of contacts and a metallic shielding shell attached thereto, wherein the housing of the plug connector includes a peripheral wall surrounding a receiving cavity in which the island is received during mating, a block is formed at one end of the peripheral wall, and the shielding shell of the plug connector forms an end part with a soldering section thereof and a notch therein above the corresponding soldering section to receive the block for securing the corresponding shielding shell and the corresponding housing together.

6. The electrical connector assembly as claimed in claim 5, wherein the housing of the receptacle connector further includes a pair of protrusions along a centerline of the housing and linked at two opposite ends of the island along a longitudinal direction, and during mating the protrusion is received within the notch of the end part.

7. The electrical connector assembly as claimed in claim 5, wherein in the plug connector each of the contacts has opposite first and second contacting section facing the receiving cavity, and one of said first and second contacting sections includes a recess for engagement with the contact of the receptacle connector.

8. The electrical connector assembly as claimed in claim 7, wherein in the receptacle connector, each of the contacts has opposite first and second contacting sections exposed upon two opposite sides of the island to respectively contact the corresponding first and second contacting sections of the plug connector during mating.

9. The electrical connector assembly as claimed in claim 1, further including a plug connector having an insulative housing, a plurality of contacts and a metallic shielding shell attached thereto, wherein in the plug connector, the housing of the plug connector includes a peripheral wall surrounding a receiving cavity in which the island is received during mating, and the shielding shell forms an outer part with a recess in which the pressing section of the receptacle connector is received during mating.

10. An electrical connector assembly comprising:

a receptacle connector including:

an insulative housing including an island surrounded by a peripheral wall thereof to have a mating cavity therebetween, the peripheral wall including a pair of side walls each defining opposite interior surface and outer surface, a recess formed in the interior surface;

a plurality of contacts retained in the housing, each of the contacts including a contacting section exposed upon the island; and a metallic shielding shell attached upon the peripheral wall and including an upper part, a pressing section extending downwardly from the upper part and received within the recess, and an outer part covering the exterior surface; and a plug connector including an insulative housing, a plurality of contacts, and a metallic shielding shell attached to the insulative housing, wherein the housing of the plug connector includes a peripheral wall surrounding a receiving cavity in which the island is received during mating, a block is formed at one end of the peripheral wall, and the shielding shell of the plug connector forms an end part having a soldering section and a notch therein above the soldering section to receive the block for securing the corresponding shielding shell and the corresponding housing together.

11. The electrical connector assembly as claimed in claim 10, wherein the housing of the receptacle connector includes a mounting section, and the shielding shell includes a notch securely receiving the mounting section.

12. The electrical connector assembly as claimed in claim 10, wherein a plurality of slots are formed in the shielding shell around the upper part to separate the pressing section into plural portions.

13. The electrical connector assembly as claimed in claim 10, wherein the shielding shell of the plug connector includes an outer part having a recess for receiving the pressing section of the receptacle connector.

14. An electrical connector assembly comprising:

a receptacle connector including:

an insulative housing including an island surrounded by a peripheral wall with a mating cavity therebetween, the peripheral wall including a pair of side walls each defining opposite interior surface and outer surface, a recess formed in the interior surface;

a plurality of contacts retained in the housing, each of the contacts including a contacting section exposed upon the island;

a metallic shielding shell attached upon the peripheral wall and including an upper part, a pressing section extending downwardly from the upper part and received within the recess, and an outer part covering the exterior surface;

a plug connector having an insulative housing, a plurality of contacts and a metallic shielding shell attached thereto, wherein the housing of the plug connector includes a peripheral wall surrounding a receiving cavity in which the island is received during mating; wherein each of the contacts of the receptacle connector includes a contacting section exposed upon the island having a first contacting section and a second contacting section exposed upon two opposite sides of the island and linked by an arc connection section located upon a top edge of the island, and further a horizontal soldering section exposed upon a bottom surface of the receptacle connector; wherein each of the contacts of the plug connector includes a first contacting portion and a second contacting portion linked by a horizontal connecting portion, an upside-down U-shaped connecting portion linked to the second contacting portion, and a horizontal soldering portion linked to said upside-down U-shaped connecting portion; where the first contacting portion further including an upside-down U-shaped hook, and during mating the upside-down U-shaped hook engages the first contacting section, and the second contacting portion engages the second contacting section.

15. The electrical connector assembly as claimed in claim 14, wherein the second contacting section of the contact of the receptacle connector forms a first recess, and the second contacting portion of the contact of the plug connector forms a second recess engaged with first recess during mating.

* * * * *